United States Patent [19]

Marsau et al.

[11] 4,306,445

[45] Dec. 22, 1981

[54] APPARATUS FOR TESTING GROUPS OF CIGARETTES OR LIKE ROD-SHAPED ARTICLES

[75] Inventors: Uwe Marsau, Dassendorf; Uwe Heitmann, Hamburg; Heinz-Christen Lorenzen, Wentorf, all of Fed. Rep. of Germany

[73] Assignee: Hauni-Werke Körber & Co. KG, Hamburg, Fed. Rep. of Germany

[21] Appl. No.: 141,125

[22] Filed: Apr. 17, 1980

[30] Foreign Application Priority Data

May 4, 1979 [DE] Fed. Rep. of Germany ..... 2918030

[51] Int. Cl.[3] ..... G01B 13/12

[52] U.S. Cl. ..... 73/37.5; 53/55; 53/148; 73/45.1

[58] Field of Search ..... 53/55, 148-151; 73/37-37.9, 78, 81, 45, 45.1; 33/169 R, DIG. 2; 131/84 R

[56] References Cited

U.S. PATENT DOCUMENTS

| | | | |
|---|---|---|---|
| 3,116,478 | 12/1963 | Powell | 53/148 |
| 3,668,928 | 6/1972 | Strydom | 73/37.5 X |
| 3,719,072 | 3/1973 | Cooke | 73/37.5 |
| 3,844,161 | 10/1974 | Kay | 73/37.5 |
| 3,956,870 | 5/1976 | Kruse et al. | 53/55 |

*Primary Examiner*—John Petrakes

*Attorney, Agent, or Firm*—Peter K. Kontler

[57] ABSTRACT

Apparatus for testing the contents of successive cells in a chain which transports arrays of cigarettes in or to a packing machine has a support for reciprocable sensing pins, each of which is caused to engage a discrete cigarette when the support is moved toward a cell. The pins are shifted relative to the support as the latter continues to move toward the array whereby the shanks, heads or collars of the pins at least partially seal openings which connect a pneumatic monitoring unit with the atmosphere. If all of the openings are properly sealed or nearly sealed, the array of cigarettes which are engaged by the pins contains a requisite number of articles and all of the cigarettes have satisfactory tobacco-containing ends. If at least one of the cigarettes is missing or has a soft tobacco filler or is empty at that end which is engaged by the respective pin, the monitoring unit generates a signal which results in segregation of the tested array so that such array cannot be admitted into a pack or cannot be processed with packs containing satisfactory arrays. A second monitoring unit determines whether or not all of the pins return to their starting positions as soon as they become disengaged from the cigarettes of an array. The second unit communicates with the atmosphere by way of apertures which are provided in the support for the pins and whose effective cross-sectional areas are reduced by the respective pins when the pins allow the effective cross-sectional areas of the corresponding openings to increase, or vice versa.

17 Claims, 3 Drawing Figures

APPARATUS FOR TESTING GROUPS OF CIGARETTES OR LIKE ROD-SHAPED ARTICLES

BACKGROUND OF THE INVENTION

The present invention relates to apparatus for testing the condition and/or other characteristics of cigarettes, cigarillos, cigars, filter rod sections, cheroots or other types of rod-shaped articles which constitute or form part of smokers' products. More particularly, the invention relates to improvements in apparatus for testing groups of parallel or substantially parallel cigarettes or analogous rod-shaped articles, for example, in a packing machine wherein arrays consisting of predetermined numbers of cigarettes are introduced into soft packs, flip-top (hinge lid) packs or other types of containers.

It is already known to test groups of cigarettes which are about to be introduced into packs consisting of one or more layers of paper, metallic foil, cardboard or like wrapping material. The groups of cigarettes are tested for several reasons, e.g., to ascertain whether or not each and every group contains a requisite number of cigarettes, whether or not the cigarettes of each group are properly oriented with respect to each other, whether or not each and every cigarettes of a group has a satisfactory tobacco-containing end, whether or not the ends of wrappers of the cigarettes are frayed or otherwise damaged, and/or for other reasons. The two main reasons for the testing of such groups are (a) to ascertain whether or not each group contains a required number of articles and (b) whether or not the cigarettes of a group are formed with satisfactory tobacco-containing ends.

U.S. Pat. No. 3,116,478 granted Dec. 31, 1963 to Powell discloses a testing apparatus wherein a housing defines a chamber for a reciprocable sensing pin. The chamber is connected with a pneumatic monitoring unit which ascertains whether or not the tobacco-containing end of a cigarette (against which the sensing pin has been advanced) is satisfactory. The sensing pin is biased by a suitable spring which yields when the housing is moved toward a cigarette, or vice versa, so that the sensing pin engages with and is displaced by the cigarette. The sensing pin has an axial bore and several transverse bores which allow the chamber to communicate with the atmosphere in extended position of the pin. If the pin is pushed into the housing by a satisfactory cigarette in the course of a testing operation, the bores cannot connect the chamber with the atmosphere and the monitoring unit cannot generate a signal which denotes that the tested cigarette is defective or absent. The open ends of the aforementioned bores are then sealed by a wall of the housing whereby the pressure in the chamber increases, and such pressure is propagated into the monitoring unit to indicate that the article which is in the process of being treated is acceptable. The apparatus which is illustrated in the aforementioned patent is intended for testing of discrete cigarettes, i.e., for testing of one cigarette at a time. However, the patent also mentions the possibility of using several sensing pins for simultaneous testing of a plurality of cigarettes.

The just discussed patented testing apparatus exhibits several drawbacks. First of all, and as shown in FIG. 3 of the patent, the sensing pin is a precision-finished component whose manufacturing cost is relatively high. The sensing pin must be received in its bore with a minimum of clearance so as to avoid leakage of air and attendant fluctuations of pressure in the interior of the chamber. Were the illustrated apparatus provided with several sensing pins, fluctuations of pressure in the chamber would be compounded in response to leakage of air between the peripheral surfaces of the sensing pins and the surfaces surrounding the respective bores therefor. Even a minor deviation of air pressure in the chamber from the optimum pressure is likely to entail the generation of a "defect" signal with the result that the tested cigarette or the tested group of cigarettes is expelled from the packing machine or is otherwise segregated from other cigarettes or groups of cigarettes. Improper sealing of or by a single sensing pin would suffice to initiate the segregation and discarding of an entire group of cigarettes, e.g., of an array of twenty cigarettes which are about to be introduced into a soft pack or a like container. Furthermore, the bores in the sensing pin or pins cannot be selected at will, especially as regards their maximum diameters, because the diameter of the sensing pin is relatively small (such diameter is or should be less than the diameter of a cigarette, especially if two or more sensing pins are to be placed sufficiently close to each other for simultaneous testing of the ends of a block or group of cigarettes in an array which is customary in a cigarette pack wherein the wrappers of neighboring cigarettes actually contact each other). In such instances, the diameters of each sensing pin must be at least slightly less than the diameter of a cigarette in order to provide room for the guide means wherein the pins are slidable during engagement with the tobacco-containing ends of satisfactory cigarettes. The making of small-diameter bores in sensing pins is expensive and time-consuming. Also, the mass of the sensing pins cannot be reduced at will even though lightweight sensing pins are desirable in order to allow to rapid movement in directions toward or away from one or more cigarettes to be tested. The difficulty of making small-diameter bores in small-diameter sensing pins is one of the factors which limits the extent to which the mass of a sensing pin can be reduced. Lightweight sensing pins are particularly desirable in modern high-speed packing machines which turn out many hundreds of packs per minute and, therefore, the apparatus which tests the ends of groups or blocks of cigarettes must test several thousand cigarettes per minute. Relatively heavy sensing pins are likely to cause the monitoring means to furnish inaccurate readings which results in rejection of numerous satisfactory groups of cigarettes or in introduction of unsatisfactory groups into packs or like containers.

OBJECTS AND SUMMARY OF THE INVENTION

An object of the invention is to provide a novel and improved apparatus for testing groups of cigarettes or like rod shaped articles in packing and analogous machines.

Another object of the invention is to provide the testing apparatus with sensing elements which need not be formed with bores and whose weight can be a small fraction of the weight of heretofore known sensing pins.

A further object of the invention is to provide a testing apparatus which is simpler, less expensive and more reliable than heretofore known testing apparatus.

An additional object of the invention is to provide the testing apparatus with novel and improved means for ascertaining and/or indicating the positions of sensing elements while such elements are disengaged from cigarettes or analogous rod-shaped articles.

Another object of the invention is to provide a testing apparatus which can be readily installed in existing cigarette packing and like machines as a superior substitute for heretofore known testing apparatus.

An ancillary object of the invention is to provide a novel and improved support for the sensing elements of the above-outlined testing apparatus.

A further object of the invention is to provide a testing apparatus which can be designed to test arrays containing any desired numbers of cigarettes or other rod-shaped articles and which can test such arrays at a speed matching the rate at which the arrays must be processed in a modern high-speed packing machine for cigarettes or the like.

The invention is embodied in an apparatus for testing groups of cigarettes or analogous rod-shaped articles for the presence and/or condition of articles. The apparatus comprises an indexible turret, an intermittently movable chain or other suitable means for locating successive groups of articles in a predetermined position (e.g., for locating groups of twenty cigarettes each, whereby each group contains a customary array of cigarettes including two outer layers of seven cigarettes each and a median layer of six cigarettes which are staggered with reference to the cigarettes of the outer layers), a hollow housing or another suitable support or carrier means having openings, each of which registers with a different article of a group which is located in the predetermined position, a plurality of sensing elements (one for each article of a group) which are installed in the support and each of which is movable in the support with reference to the corresponding opening, and means for effecting relative movement between the locating means and the support (e.g., a piston rod or a like device which can move the support relative to the locating means) so as to engage the sensing elements with the corresponding articles in the group occupying the predetermined position and to thereupon induce a movement of sensing elements in a predetermined direction with respect to the support or vica versa whenever an element engages a satisfactory article of a group in the predetermined position whereby the thus moved sensing elements reduce the effective cross-sectional areas of the corresponding openings.

The sensing elements may comprise heads, shanks, collars, rings or other means for sealing the corresponding openings in response to engagement with satisfactory articles of a group in the predetermined position and ensuing relative movement between the sensing elements and the support. The apparatus preferably further comprises means for yieldably opposing relative movement between the sensing elements and the support. Such opposing means can comprise helical springs or other resilient means reacting against the support and bearing against the associated sensing elements.

The apparatus preferably further comprises pneumatic means for monitoring the extent of relative movement between the sensing elements and the support and for generating signals denoting whether or not the extent of relative movement between the support and each and every sensing element is sufficient to warrant the assumption that all articles of a group are present and that each such article is satisfactory (e.g., that the head of each cigarette contains a tobacco filler of requisite density). The monitoring means includes or can be said to include a plurality of valves which are connected in parallel and each of which includes a valving element constituted by one of the sensing elements and a seat including a portion of the support (each such portion of the support is formed with one of the aforementioned openings). The openings communicate with the atmosphere when the respective valving elements are disengaged from the corresponding articles of a group of articles in the predetermined position.

In accordance with another feature of the invention, the support has apertures, one for each sensing element, and the effective cross-sectional area of an aperture increases in response to a reduction of the cross-sectional area of the corresponding opening in the support, or vice versa. The apparatus then comprises second pneumatic monitoring means including a plurality of valves, each of which comprises one of the sensing elements and that portion of the support which is formed with the corresponding aperture. The second monitoring means serves to ascertain whether or not all of the sensing elements are held in preselected starting positions prior to engagement with the articles of a group which is located in the aforementioned predetermined position.

The novel features which are considered as characteristic of the invention are set forth in particular in the appended claims. The improved testing apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
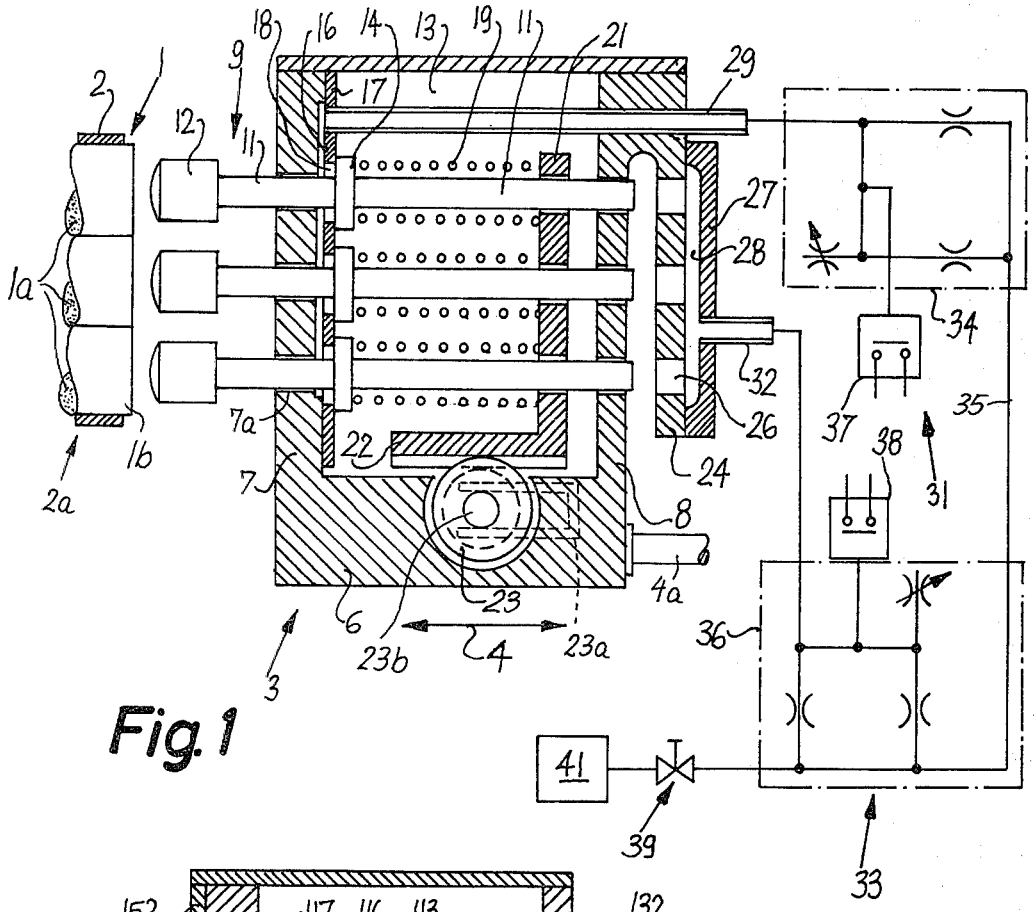
FIG. 1 is a somewhat schematic partly elevational and partly sectional view of a testing apparatus which embodies one form of the invention and whose sensing elements have heads which are movable into engagement with the adjacent end faces of cigarettes forming an array in the cell of an endless chain serving to transport groups of cigarettes in or to a packing machine.

The apparatus 3 which is shown in FIG. 1 serves for testing of cigarette blocks or groups 1. These blocks are transported in or to a cigarette packing machine for introduction into discrete soft packs or hinge lid packs. In the embodiment of FIG. 1, the block 1 is confined, in a predetermined position, in one of several cells 2 of a conveyor in the form of an endless chain 2*a* forming part of or being combined with the packing machine. If desired, the chain 2*a* can be replaced with a turret or wheel which has compartments or cells for groups or blocks of parallel cigarettes 1*a*. An endless chain which can perform the function of the chain 2*a* is shown at 3 in the drawing of the commonly owned U.S. Pat. No. 3,956,870 granted May 18, 1976 to Friedel Kruse et al. The manner in which the chain 2*a* is driven in stepwise fashion so as to place successive groups or blocks 1 into register with the testing apparatus 3 (i.e., to locate successive blocks 1 in a predetermined position) is or can be the same as in the aforementioned U.S. Pat. No. 3,956,870 whose disclosure is incorporated herein by reference.

The testing apparatus 3 comprises a housing or support 6 for a set of spaced parallel elongated reciprocable sensing elements in the form of pins 9. A completed set for pins 9 includes one pin for each cigarette 1*a* of the block or group 1. The cigarettes 1*a* are arrayed in the customary formation, namely, the block 1 comprises two outer layers of seven parallel cigarettes 1*a* each and a median layer consisting of six cigarettes which are staggered with reference to the cigarettes of the outer layers. Such formation are known as quincunx formations. It goes without saying that the apparatus 3 can be designed for testing of cigarettes which form blocks of four, five, ten, twenty-one or any other selected number of parallel cigarettes.

When the chain or locating means 2*a* comes to a standstill, the support 6 of the testing apparatus 3 is moved in a direction to the left, as viewed in FIG. 1, so as to move the enlarged front end portions or heads 12 of the pins 9 toward and into engagement with the tobacco-containing end portions or heads 1*b* of the respective cigarettes 1*a* in the block 1 which dwells in the illustrated (predetermined position). The means for moving the support 6 back and forth (see the double-headed arrow 4) is not shown in detail; such means may comprise a double-acting cylinder and piston unit including a piston rod 4*a* which is attached to the support 6. It is further clear that such moving means can include two cylinder and piston units or other suitable shifting means (e.g., a rack and pinion drive, not shown). All that counts is to ensure that the holder 6 can be moved from the illustrated retracted or inoperative position to an extended or operative position (namely, in a direction to the left, as viewed in FIG. 1) and back to the illustrated retracted position. During the first stage of movement of the support 6 to the extended position, the positions of the sensing pins 9 with reference to the support 6 remain unchanged. However, when the heads 12 of the sensing pins 9 strike against the heads 1*b* of the respective cigarettes 1*a*, the pins 9 are arrested while the support 6 continues to move in a direction to the left (i.e., the pins 9 can be said to move relative to the support 6, or vice versa) whereby the pins 9 stress suitable biasing means, here shown as resilient elements in the form of helical springs 19. Each spring 19 reacts against a mobile internal supporting wall 21 of the support 6 and bears against an enlarged portion or collar 14 of the respective pin 9. The collars 14 can be said to constitute abutments extending radially beyond the main portions or shanks 11 of the respective sensing pins 9.

The shanks 11 of the sensing pins 9 are reciprocable in spaced parallel walls 7 and 8 of the support 6. These shanks are relatively thin, i.e., their diameters can constitute small fractions of the diameters of cigarettes 1*a*.

The inner side or surface of the wall 7 has a relatively shallow depression or recess 16 which constitutes a chamber and is overlapped by a plate-like member 17 of the support 6. The plate-like member 17 has a set of bores or apertures 18, one for each of the sensing pins 9. The shank 11 of each sensing pin 9 extends with clearance through the respective aperture 18 but the outer diameter of the corresponding collar 14 is larger than the diameter of an aperture 18 so that the apertures are sealed by the collars 14 when the springs 19 are free to expand, i.e., when the springs 19 are free to maintain the respective sensing pins 9 in the left-hand end positions, as viewed in FIG. 1. The chamber 16 is then sealed or practically sealed from the atmosphere including the internal space 13 of the major portion of the support 6. The leakage of air through the bores 7*a* of the wall 7 can be disregarded.

The bias of the springs 19 can be regulated by moving the supporting wall 21 in the axial direction of the sensing pins 9. The means for effecting such movement includes a toothed rack 22 which is affixed to or made integral with the supporting wall 21 and is parallel to the shanks 11, and a pinion 23 which is rotatably mounted in the bottom wall of the support 6 and is normally held in a selected position by a suitable clamping or arresting device 23*a*. When the clamping device 23*a* is released or disengaged, an attendant or a servomotor can rotate the shaft 23*b* of the pinion 23 to thereby move the rack 22 and the supporting wall 21 in a direction to the right or to the left, as viewed in FIG. 1. Such adjustment may be necessary in order to ensure that the heads 12 of the sensing pins 9 can penetrate into the tobacco fillers in the heads 1*b* of unsatisfactory cigarettes 1*a*, i.e., that the heads 12 can assume positions which are indicative of relatively or excessively soft heads 1*b*. Moreover, the bias of the springs 19 will be adjusted in order to ensure that the collars 14 will always bear against the right-hand side of the plate-like member 17 when the heads 12 are disengaged from the respective cigarettes 1*a*.

The support 6 further comprises a wall 24 which is outwardly adjacent to and parallel with the wall 8. The wall 24 has bores of openings 26, one of each of the sensing pins 9. The diameters of the openings 26 equal or very closely approximate the diameters of the shanks 11 so that, when a shank 11 penetrates into the corresponding opening 26, the latter is sealed or practically sealed and prevents the flow of atmospheric air between the atmosphere and a chamber 28 which is formed by the wall 24 and a cover or lid 27. The latter is separably or permanently affixed to the outer side of the wall 24. It will be noted that the right-hand end portions of the shanks 11 act not unlike plungers to reduce the effective cross-sectional areas of the openings 26 (in the illustrated embodiment, the effective cross-sectional areas of such openings are reduced to zero) whenever the support 6 continues to move in a direction to the left subsequent to stoppage of the sensing pins 9, i.e., after the heads 12 or the sensing pins 9 engage and are arrested by the heads 1*b* of aligned cigarettes 1*a* in the block 1 which is located in the predetermined position of FIG. 1.

The chamber 16 communicates with one end of a conduit 29 which connects this chamber with the bridge circuit 34 of a pneumatic monitoring unit 31 including a pressure-responsive signal-generating transducer 37. This transducer generates signals which are used to segregate the corresponding blocks 1 from other blocks, e.g., to prevent the insertion of a block, which has caused the transducer 37 to generate a signal, into a soft cigarette pack or into a hinge lid pack.

The chamber 28 communicates with one end portion of a conduit 32 which is further connected with the bridge circuit 36 of a pneumatic monitoring unit 33 including a pressure-responsive signal-generating transducers 38. The latter generates a signal when the pressure in the chamber 28 is too low because at least one of the shanks 11 fails to seal the corresponding opening 26 in the extended or left-hand end position of the support 6. The monitoring units 31 and 33 are connected with a source 41 of pressurized fluid (preferably compressed air) by way of an adjustable pressure regulating valve 39. The exact nature of the bridge circuits 34 and 36 forms no part of the present invention; such circuits are known per se and their design can but need not deviate from the illustrated design without departing from the spirit of the invention.

It will be noted that the collars 14 of the sensing pins 9 reduce the effective cross-sectional areas of the corresponding apertures 18 when the shanks 11 increase the effective cross-sectional areas of the corresponding (aligned) openings 26, and vice versa. In the embodiment of FIG. 1, the openings 18 are sealed when the apertures 26 are exposed, and vice versa.

The transducers 37 and 38 transmit signals to the electrical or electronic detector and control system of the packing machine in a manner not forming part of the invention. For example, the control system receives a signal from the monitoring unit 31 (transducer 37) prior to start of movement of the support 6 toward the block 1 in the adjacent cell 2 of the conveyor chain 2*a*. When the leftward movement of the support 6 is completed, the control system of the packing machine receives a signal from the output of the transducer 38. The control system ascertains whether or not the signals from the outputs of the transducers 37, 38 reach or exceed preselected values. The signals which are transmitted by the transducer 37 denote whether or not the testing apparatus 3 operates satisfactorily, e.g., whether or not the support 6 is contaminated to such an extent that one or more springs 19 are incapable of maintaining the respective sensing pins 9 in the illustrated end positions when the heads 12 are not in engagement with cigarettes 1*a*. The signals which are transmitted by the transducer 38 denote whether or not the respective heads 12 engage cigarettes 1*a* as well as whether or not the density of fillers in the heads 1*b* of the respective cigarettes 1*a* is acceptable.

The operation of the testing apparatus 3 is as follows:

Before the piston rod 4*a* moves the support 6 toward the conveyor 2*a*, the aforementioned control system of the packing machine receives a signal from the output of the transducer 37 in the monitoring system 31. If the intensity or another characteristic of such signal reaches or exceeds a predetermined value, namely, a value corresponding to a preselected pressure of fluid in the chamber 16, the pressure in the chamber 16 is sufficiently high to denote that all of the collars 14 engage the right-hand side of the plate-like member 17, i.e., that the conduit 29 (which is preferably at least partially flexible, the same as the conduit 32) cannot permit excessive amounts of atmospheric air to flow from the bridge circuit 34 of the monitoring unit 31 into the atmosphere via chamber 16. Consequently, the operation of the testing apparatus 3 is proper. The timing of transmission of signals from the transducer 37, 38 to the control system of the packing machine is determined by a suitable pulse generator which is not specifically shown and which serves to synchronize the operation of various components of the packing machine. If the operation of the testing apparatus 3 is unsatisfactory, e.g., because a particle of dust or a speck of tobacco has penetrated between a portion of one of the sensing pins 9 and the support 6 so that the corresponding spring 19 is incapable of maintaining the collar 14 in sealing engagement with the member 17, the respective aperture 18 communicates with the atmosphere and allows compressed air issuing from the source 41 and flowing into the bridge conduit 34 via conduit 35 to escape into the atmosphere via conduit 29 and chamber 16. The electric signal which is transmitted by the transducer 37 under the just outlined circumstances can be used to arrest the packing machine or to generate a visible and/or audible signal which is detected by one or more attendants in charge.

If the operation of the testing apparatus 3 is satisfactory, the piston rod 4*a* advances the support 6 toward the block 1 which dwells in the illustrated (predetermined) position because the conveyor chain 2*a* is then idle. It will be recalled that the conveyor chain 2*a* is advanced in stepwise fashion. The heads 12 of the sensing pins 9 engage the heads 1*b* of the respective cigarettes 1*a* in the block 1, and the sensing pins come to a halt (provided that the block 1 contains a requisite number of properly arrayed cigarettes 1*a* and that the head 1*b* of each cigarette 1*a* contains a tobacco filler of satisfactory density). The support 6 continues to move in a direction to the left, as viewed in FIG. 1, so as to effect a relative movement between the sensing pins 9 and the walls 7, 8, 21, 24 of the support 6. The leftward movement of the support 6 is terminated when the right-hand end portions of the shanks 11 extend into the respective openings 26 and seal the chamber 28 from the atmosphere. This enables the compressed fluid which issues from the source 41 and enters the bridge circuit 36 to build up a requisite pressure in the monitoring unit 33, namely, a pressure which causes the transducer 38 to transmit an electric signal whose intensity or another characteristic equals or exceeds a preselected threshold value. The threshold value is selected in such a way that a signal whose intensity equals or exceeds this value is indicative of the presence of twenty cigarettes 1*a* have satisfactory heads 1*b*. The absence of a single cigarette 1*a* in the block 1, or the presence of a single cigarette wherein the head 1*b* is too soft, suffices to prevent adequate sealing of the chamber 28 from the atmosphere so that the compressed fluid can escape from the bridge circuit 36 via conduit 32 and chamber 28 whereby the electric signal which is generated at the output of the transducer 38 denotes that the apparatus 3 is in the process of testing an unsatisfactory block 1. It will be readily appreciated that the chamber 28 will be free to communicate with the atmosphere even if each and every sensing pin 9 is depressed during the second stage of leftward movement of the support 6 under the action of the piston rod 4*a*. Nevertheless, the signal at the output of the transducer 38 will denote the testing of an unsatisfactory block 1 if at least one of the heads 1*b* is too soft so that the corresponding shank 11 cannot properly seal the registering opening 26. The just discussed "defect" signal at the output of the transducer 38 can be used to expel the respective block 1 from its cell 2 before such block enters a container, e.g., a soft pack or a hinge lid pack. The exact mode of processing "defect" signals for ejection or segregation of the corresponding blocks 1 is known in the art of packing machines for cigarettes or the like.

Certain component parts in or of the support 6 can be said to constitute a set of values which are connected in parallel and form part of the pneumatic monitoring unit 33. Each valve includes a valving element constituted by the right-hand portion of a shank 11, and that portion of the wall 24 which defines the registering opening 26. The wall 24 can be said to constitute a seat which can snugly receive the right-hand portions of the shanks 11 when the heads 12 are depressed toward the wall 7 in response to engagement with the heads 1*b* of aligned cigarettes 1*a* while the support 6 continues to move towards its left-hand end position.

Figure 2:
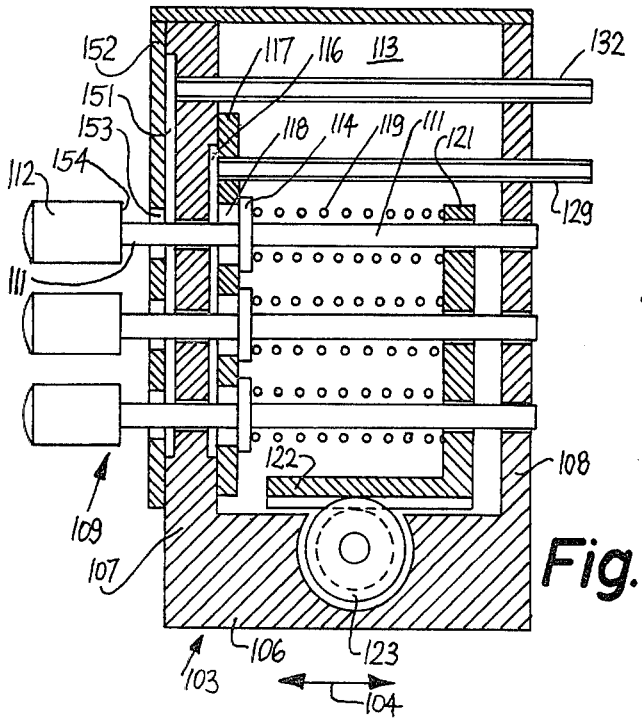
FIG. 2 is a similar partly elevational and partly sectional view of a portion of a modified testing apparatus.

FIG. 2 shows a portion of a second testing apparatus 103 wherein all such parts which are identical with or clearly analogous to corresponding parts of the testing apparatus 3 are denoted by similar reference characters plus 100.

A readily discernible difference between the testing apparatus 3 and 103 is that a second plate-like member 152 of the support 106 is adjacent to the outer side of the wall 107 and that such outer side of the wall 107 has a recess which enables the components 107 and 152 to define a chamber 151. The chamber 151 corresponds to the chamber 28 of FIG. 1, the openings 153 are provided in the plate-like member 152. The diameter of each opening 153 exceeds the diameter of the respective shank 111 but is smaller than the diameters of the heads 112 of the respective sensing pins 109. Therefore, the inner end faces 154 of the heads 112 seal the respective openings 153 from the surrounding atmosphere when the left-hand end portions of the heads 112 engage the cigarettes (not shown) of a block which is held in the aforediscussed predetermined position. The openings 153 are sealed when the support 106 reaches its left-hand end position. The chamber 151 is connected with the associated pneumatic monitoring unit (not shown because it can be identical with the monitoring unit 33 of FIG. 1) by way of the conduit 132 which is preferably deformable or includes one or more flexible or elastic portions.

The manner in which the chamber 116 between the inner side of the wall 107 and the plate-like member 117 can be sealed from the atmosphere by way of collars 114 on the respective shanks 111 and the manner in which the chamber 116 is connected with the associated pneumatic monitoring unit (corresponding to the monitoring unit 31 of FIG. 1) is the same as described in connection with FIG. 1. The conduit 129 is flexible or includes one or more deformable portions, provided that the associated monitoring unit is stationary.

Figure 3:
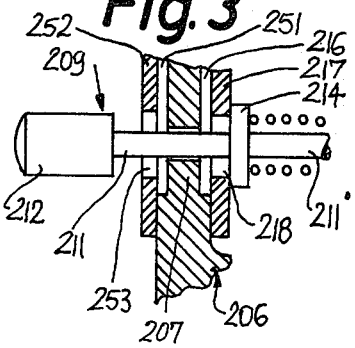
FIG. 3 is a fragmentary sectional view of a detail in a testing apparatus which constitutes a modification of the apparatus shown in FIG. 2.

FIG. 3 illustrates a portion of a third testing apparatus wherein all such parts which are identical with or clearly analogous to the corresponding parts of the apparatus 103 of FIG. 2 are denoted by similar reference characters plus 100. The main difference between the testing apparatus of FIGS. 2 and 3 is that the diameters of openings 253 in the plate-like member 252 at the outer side of the wall 207 match or vary closely approximate the diameters of the heads 212 so that these heads can penetrate into and thereby seal the respective openings 253 when the support 206 reaches its left-hand end position and each of the heads 212 engages a satisfactory cigarette head, not shown. It can be said that each of the heads 212 is a plunger which penetrates into and seals the respective opening 253 when the corresponding sensing pin 209 engages a satisfactory cigarette and the support 206 has been moved to its fully extended position. The manner in which the extent to which the chambers 216 and 251 are sealed from the atmosphere can determine whether or not the operation of the testing apparatus is satisfactory and whether or not the testing apparatus maintains its sensing pins 209 (only one shown in FIG. 3) in engagement with a requisite number of satisfactory cigarettes is preferably the same as described in connection with FIG. 1. The chambers 216, 251, respectively, correspond to the chambers 28 and 16 in the support 6 of FIG. 1.

The testing apparatus of the present invention can be used as a superior substitute for the testing apparatus which is described in col. 7, lines 35–55 of the aforementioned U.S. Pat. No. 3,956,870 to Kruse et al.

An important advantage of the improved testing apparatus is that its sensing pins 9, 109 or 209 can be mass-produced at a reasonable cost and need not be machined with an extremely high degree of precision. Furthermore, the pins are of lightweight construction because the diameters of their shanks can be reduced practically at will. This will be readily appreciated since the shanks need not be formed with axial and/or transverse bores which are necessary in conventional sensing pins and contribute to the complexity and cost of such parts.

Another important advantage of the improved testing apparatus is that it can automatically produce signals which indicate to the attendants whether or not the operation of the apparatus is satisfactory. This is quite important when the apparatus is used for the testing of cigarette blocks in packing or like machines which are likely to generate a certain amount of tobacco dust whereby the particles of dust will or can interfere with desired movements of sensing pins relative to their support.

The provision of sensing pins, certain portions of which perform the functions of plungers, is often desirable and advantageous because such sensing pins can properly seal the associated openings or apertures regardless of whether or not the support invariably moves between identical end positions and regardless of whether or not the extent of movement of sensing pins relative to the support (while the support continues to move after the sensing pins are already arrested) is always the same.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. In an apparatus for testing groups of cigarettes or analogous rod-shaped articles for the presence and/or condition of articles, the combination of means for locating successive groups of articles in a predetermined position; a support having openings each registering with a different article of a group in said predetermined position; a plurality of sensing elements installed in said support, one for each of said openings and each movable in said support with reference to the corresponding opening; and means for effecting relative movement between said locating means and said support so as to engage said elements with the corresponding articles of the group in said predetermined position and to thereupon induce a relative movement between said elements and said support whenever an element engages a satisfactory article of a group in said predetermined position whereby the sensing elements reduce the effective cross-sectional areas of the respective openings.

2. The combination of claim 1, wherein said sensing elements have means for sealing the corresponding openings in response to engagement with satisfactory articles of a group in said predetermined position and ensuing relative movement between such elements and said support.

3. The combination of claim 1, further comprising means for yieldably opposing said relative movement between said sensing elements and said support upon engagement of such elements with satisfactory articles of a group in said predetermined position.

4. The combination of claim 3, wherein said means for yieldably opposing comprises resilient means reacting against said support and bearing against said elements.

5. The combination of claim 1, further comprising pneumatic means for monitoring the extent of relative movement between said elements and said support, said monitoring means including a plurality of valves connected in parallel and each including a valving element constituted by one of said sensing elements and a seat including a portion of said support, each such portion of said support having one of said openings.

6. The combination of claim 5, wherein said openings communicate with the atmosphere when the respective valving elements are disengaged from the corresponding articles of a group in said predetermined position.

7. The combination of claim 6, wherein said support has apertures, one for each of said sensing elements, the effective cross-sectional area of each of said apertures being increased in response to a reduction of the effective cross-sectional area of the corresponding opening by the respective sensing element and vice versa.

8. The combination of claim 7, further comprising second pneumatic monitoring means including a plurality of valves each comprising one of said elements and the respective aperture.

9. The combination of claim 8, further comprising means for yieldably biasing said elements in a direction to increase the effective cross-sectional areas of the corresponding openings and to thus reduce the effective cross-sectional areas of the corresponding apertures.

10. The combination of claim 9, wherein said second monitoring means includes means for generating signals in response to failure of said biasing means to effect a reduction of the effective cross-sectional area of at least one of said apertures while said elements are disengaged from the articles of a group in said predetermined position.

11. The combination of claim 7, wherein said support includes a wall and said apertures are provided in said wall.

12. The combination of claim 11, wherein each of said elements has a reciprocable shank and an enlarged portion provided on said shank and arranged to reduce the effective cross-sectional area of the corresponding aperture in response to relative movement between such element and said support while the element engages a satisfactory article.

13. The combination of claim 12, wherein said wall is located in the path of movement of said portions of said elements in a direction counter to the direction of relative movement between said elements and said support upon engagement between the elements and satisfactory articles, and further comprising means for biasing said portions of said elements against said wall, said wall having a side facing said portions of said elements and said apertures being provided in said side of said wall.

14. The combination of claim 1, wherein said sensing elements include plungers which penetrate into the corresponding openings in response to relative movement between said elements and said support.

15. The combination of claim 1, wherein said sensing elements comprise portions which overlap the respective openings in response to relative movement between said elements and said support.

16. The combination of claim 15, wherein said portions of said elements are heads.

17. The combination of claim 1, wherein said support has apertures, one for each of said sensing elements, the effective cross-sectional area of each of said apertures being increased by the respective element when the latter reduces the effective cross-sectional area of the corresponding opening and vice versa, said elements having collars which are movable toward and away from positions of overlap with the respective apertures.

* * * * *